US005765711A

United States Patent [19]

Johnson et al.

[11] Patent Number: 5,765,711

[45] Date of Patent: Jun. 16, 1998

[54] COMPOSITE PACKAGE

[75] Inventors: Ralph W. Johnson, Hawthorn Woods; Gerald D. Williams, Manhattan, both of Ill.

[73] Assignee: Container Specialties, Inc.

[21] Appl. No.: 723,045

[22] Filed: Sep. 30, 1996

[51] Int. Cl.[6] ..... B65D 21/02

[52] U.S. Cl. ..... 220/468; 220/410; 220/441; 220/23.86; 229/117.24

[58] Field of Search ..... 220/408, 410, 220/441, 468, 23.83, 23.86, 229; 229/117.09, 117.23, 117.24, 120.03; 215/12.1, 12.2

[56] References Cited

U.S. PATENT DOCUMENTS

| | | | |
|---|---|---|---|
| 2,019,307 | 10/1935 | Hill et al. . | |
| 2,760,677 | 8/1956 | Arneson . | |
| 2,954,901 | 10/1960 | Winstead . | |
| 2,965,277 | 12/1960 | Prieto | 229/120.03 |
| 3,054,549 | 9/1962 | Humphrey . | |
| 3,119,544 | 1/1964 | Cope et al. . | |
| 3,160,326 | 12/1964 | Sturdevant et al. . | |
| 3,349,986 | 10/1967 | Chapman et al. . | |
| 3,390,810 | 7/1968 | Schneeweiss | 229/120.03 X |
| 3,499,582 | 3/1970 | Berney . | |
| 4,133,428 | 1/1979 | Glöyer . | |
| 4,174,051 | 11/1979 | Edwards et al. . | |
| 4,186,846 | 2/1980 | Jacalone et al. | 220/468 |
| 4,314,639 | 2/1982 | Glöyer . | |
| 4,782,945 | 11/1988 | Geiler et al. | 220/410 |
| 4,927,042 | 5/1990 | Ring . | |
| 5,240,174 | 8/1993 | Wenninger | 229/120.03 X |
| 5,366,141 | 11/1994 | Stone | 229/120.03 |
| 5,462,169 | 10/1995 | Dygert et al. | 220/410 |
| 5,497,899 | 3/1996 | Wuerfel . | |

*Primary Examiner*—Stephen J. Castellano
*Attorney, Agent, or Firm*—Wallenstein & Wagner, Ltd.

[57] ABSTRACT

A composite package comprising a paperboard container and a preformed receptacle positioned within the container. The receptacle includes vertical front, rear, first and second side walls, and a top wall extending across the vertical walls. A pouring spout and a handle are formed on the top wall, the pouring spout being adjacent the front wall and the handle extending between the pouring spout and the rear wall. The paperboard container includes front, rear and first and second side walls adjacent the front, rear and first and second side walls of the receptacle respectively. Each wall of the paperboard container has two end-portions separated by a mid-portion. The paperboard container also includes a top flap assembly having first and second side flaps connected to and folded substantially perpendicular to the first and second side walls, two front flaps, each front flap connected to an end-portion of the front wall, and two rear flaps, each rear flap connected to an end-portion of the rear wall. The front and rear flaps are folded substantially perpendicular to the front and rear walls.

22 Claims, 3 Drawing Sheets

COMPOSITE PACKAGE

TECHNICAL FIELD

The present invention relates generally to a composite package comprised of an inner preformed receptacle housed within an outer paperboard container. Specifically, the outer paperboard container has an improved top flap assembly.

BACKGROUND OF THE INVENTION

Composite packages including a thin-walled plastic receptacle positioned within a corrugated paperboard box have been used in the food and restaurant industry to package various types of liquids, including cooking oils. The plastic receptacle may take a variety of sizes (e.g., 2.5, 5, 10 gallons, especially 4.6 gallons or 35 lb). Generally, the top end of the receptacle has a pouring spout adjacent a front wall and an elongated handle extending from the spout to a rear wall. The paperboard container has a top flap assembly which includes two minor side flaps, each having a cutout portion adjacent the front wall of the container to accommodate the spout of the receptacle and a second cutout portion adjacent the rear wall of the container to provide access to the handle of the receptacle. The top flap assembly also includes major front and rear flaps. The front flap has a cutout opening which overlies the spout of the receptacle and the rear flap has two elongated parallel cutout slots separated by a solid center strip. The cutout slots provide access to the handle of the receptacle. The top flap assembly is closed by folding the minor flaps perpendicularly inward from the side walls of the container. The major flaps are then folded perpendicularly inward from the front and rear walls of the box and glued to the minor flaps. Both the major and minor flaps constitute a single flap that extends along the entire length of a respective wall of the box. Examples of such prior art composite packages are disclosed in U.S. Pat. Nos. 5,114,028 and 5,497,899.

The design of these prior composite packages has several drawbacks. First, the top flap assembly overlies and rests on the handle of the receptacle to provide a flat surface for stacking composite packages on top of one another. In such a design, the pouring spout cannot extend beyond the top flap assembly. Thus, a poor pouring angle between the pouring spout and a receiving container exists, especially when the receptacle is full of liquid product. Consequently, pouring often results in spillage and a loss of product and, inevitably, to deteroration of the paperboard container.

Second, the prior designs of composite packages often do not provide adequate hand clearance for access to the handle. Consequently, gripping and moving such packages can be difficult.

Finally, the top flap assembly design of prior composite packages is inefficient. Since the top flap assembly extends across the entire top end of the receptacle (overlying the handle and the pouring spout) with the side, front and rear flaps of the top flap assembly overlapping one another, the assembly uses more paperboard material than is necessary. Consequently, the prior composite packages are more expensive to manufacture.

SUMMARY OF THE INVENTION

Accordingly, it is an object of the present invention to provide a composite package wherein the receptacle can be lifted from a first position to a second position within the paperboard container, thus, improving the pour angle between the spout and a receiving container and eliminating spillage.

A further object of the present invention is to provide a composite package with a top flap assembly that has improved hand clearance for easy access to the handle of the receptacle. With the improved top flap assembly of the present invention one may readily grasp the handle of the receptacle to (1) lift the package to pour liquid from the receptacle and (2) load the package for shipping and transportation purposes.

Still another object of the present invention is to provide a composite package having a top flap assembly that uses less paperboard material than prior designs, resulting in a substantial cost savings over prior designs.

In a first aspect, the present invention provides a paperboard container comprising a front wall, rear wall, and first and second sidewalls. Each wall includes two end-portions separated by a mid-portion. The top end of the container includes a top flap assembly having first and second side flaps connected to and folded substantially perpendicular to the first and second sidewalls, two front flaps, each front flap connected to an end-portion of the front wall, and two rear flaps, each rear flap connected to an end-portion of the rear wall. The front and rear flaps are folded substantially perpendicular to the front and rear walls.

A second aspect of the present invention provides a composite package comprising a paperboard container and a preformed receptacle positioned within the container. The receptacle includes vertical front, rear, first and second side walls, and a top wall extending across the vertical walls. A pouring spout and a handle are formed on the top wall, the pouring spout being adjacent the front wall and the handle extending between the pouring spout and the rear wall. The paperboard container includes front, rear and first and second sidewalls adjacent the front, rear and first and second sidewalls of the receptacle respectively. Each wall of the paperboard container has two end-portions separated by a mid-portion. The paperboard container also includes a top flap assembly having first and second side flaps connected to and folded substantially perpendicular to the first and second sidewalls, two front flaps, each front flap connected to an end-portion of the front wall, and two rear flaps, each rear flap connected to an end-portion of the rear wall. The front and rear flaps are folded substantially perpendicular to the front and rear walls.

In another aspect of the present invention there is provided a composite package comprising a paperboard container and a preformed receptacle positioned within the container. The receptacle includes vertical front, rear, first and second side walls. A top wall extends across the vertical walls. A pouring spout is formed on the top wall adjacent the front wall. A handle is also formed on the top wall and extends between the pouring spout and the rear wall. The paperboard container includes a front wall, rear wall, and first and second sidewalls, each wall having two end-portions separated by a mid-portion. The container further includes a top flap assembly having first and second side flaps connected to and folded substantially perpendicular to the first and second sidewalls, a front flap connected to the front wall, and a rear flap connected to the rear wall. The front and rear flaps are folded substantially perpendicular to the front and rear walls. The first and second side flaps extend from the first and second sidewalls by a distance $D_1$ and $D_2$ respectively. $D_1$ and $D_2$ are such that when the side flaps are folded substantially perpendicular to the sidewalls the side flaps overlie the top wall of the receptacle, but do not overlie the handle or the pouring spout of the receptacle.

In a final aspect of the present invention the composite package comprises a top flap assembly with first and second side flaps connected to and folded substantially perpendicular to the first and second sidewalls respectively, a front flap connected to the front wall, and a rear flap connected to the rear wall. The front and rear flaps are folded substantially perpendicular to the front and rear walls respectively. The front and rear flaps have cut-out portions such that the front and rear flaps extend across the top wall of the receptacle, but do not extend across the handle or the pouring spout of the receptacle.

Other advantages and aspects of the present invention will become apparent upon reading the following description of the drawings and detailed description of the invention.

DETAILED DESCRIPTION OF THE PREFERRED EMBODIMENT

Figure 2:
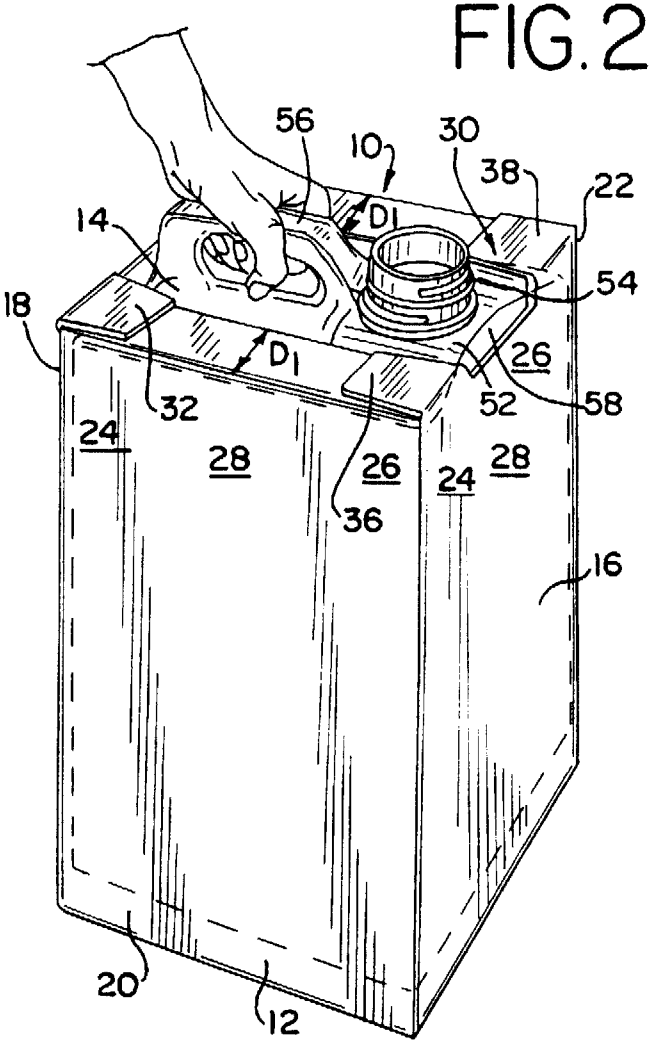
FIG. 2 is a perspective view of the composite package illustrated in FIG. 1 with top flap assembly in a first folded position and the receptacle in a second raised position within the paperboard container.

While this invention is susceptible of embodiment in many different forms, there is shown in the drawings and will herein be described in detail preferred embodiments with the understanding that the present disclosure is to be considered as an exemplification of the principles of the invention and is not intended to limit the broad aspect of the invention to the embodiments illustrated.

Figure 1:
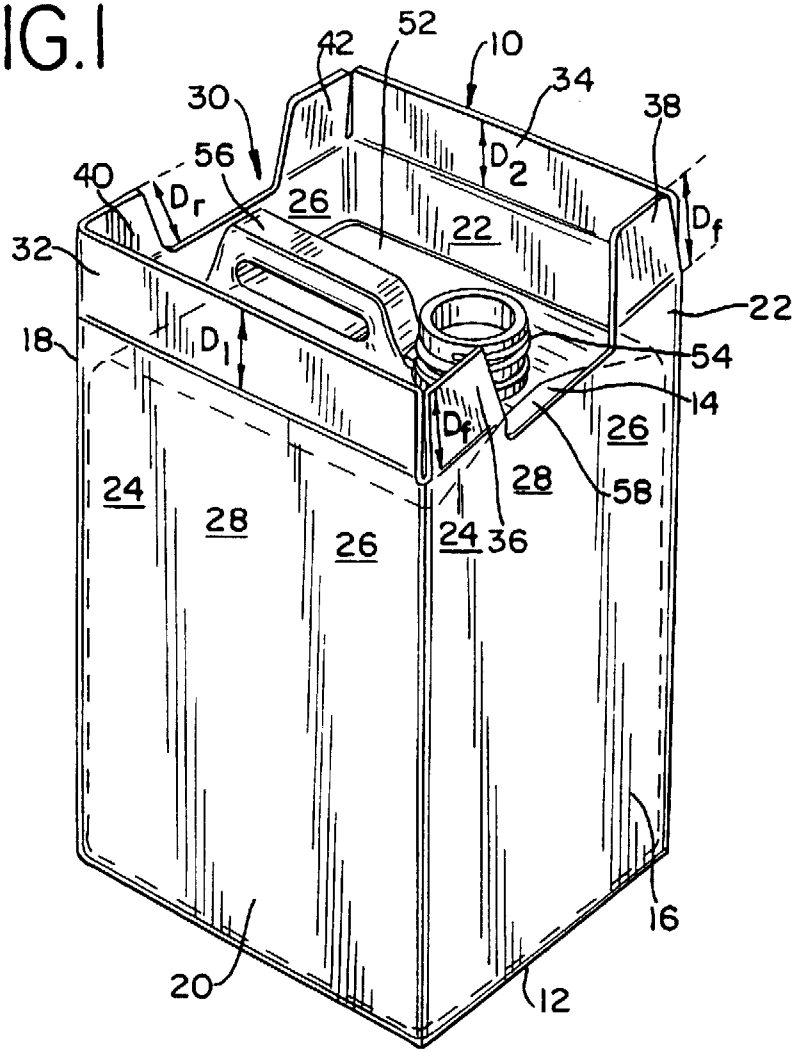
FIG. 1 is a perspective view of a composite package according to a first embodiment of the present invention, illustrating the top flap assembly in an open, unfolded position and the receptacle in a first lowered position within the paperboard container.
Figure 3:
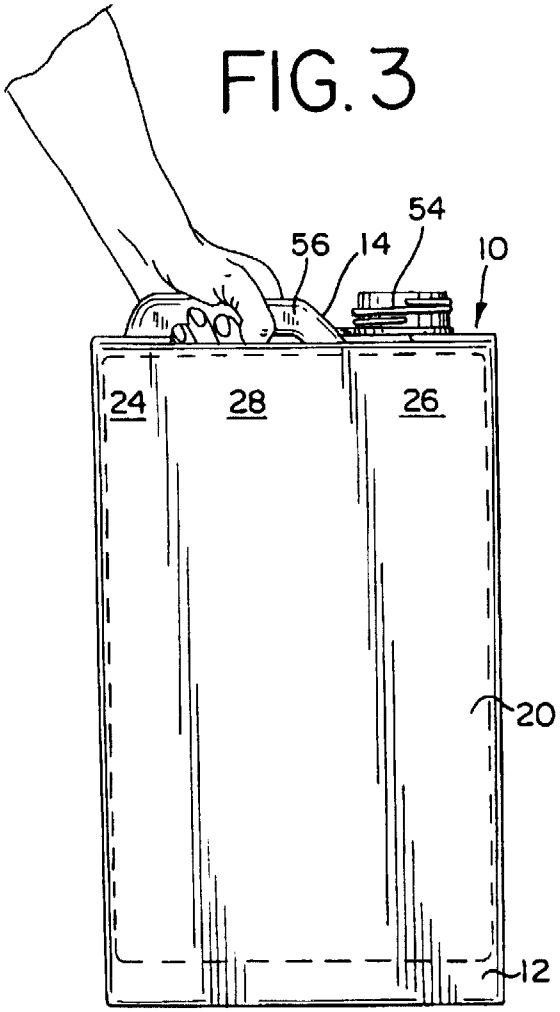
FIG. 3 is a side view of the paperboard container illustrated in FIG. 2.

FIGS. 1–3 illustrate a composite package 10 according to a first embodiment of the present invention. The composite package 10 is comprised of a paperboard container 12 and a thin-walled receptacle 14. The paperboard container 12 includes a front wall 16, rear wall 18 and first and second side walls 20,22. Each wall has two opposing end-portions 24,26 separated by a mid-portion 28. The paperboard container 12 further includes a top flap assembly 30 and a bottom flap assembly (not shown).

The top flap assembly 30 includes first and second side flaps 32,34, two front flaps 36,38, and two rear flaps 40,42. The first and second side flaps 32,34 are connected to and folded substantially perpendicular to the first and second side walls 20,22. Each front flap 36,38 is connected to an opposing end-portion 24,26 of the front wall 16 and is folded substantially perpendicular to the front wall 16. Each rear flap 40,42 is connected to an opposing end-portion 24,26 of the rear wall 18 and is folded substantially perpendicular to the rear wall 18.

The thin-walled receptacle 14 rests within the paperboard container 12 and includes vertical front, rear, and first and second side walls. A top wall 52 extends across each vertical wall. A pouring spout 54 is formed on the top wall 52 adjacent the vertical front wall of the receptacle 14. An elongated handle 56 is also formed on the top wall 52 and extends between the pouring spout 54 and the vertical rear wall of the receptacle 14. In the preferred embodiment illustrated in FIGS. 1–3, the thin-walled receptacle 14 is a rectangular plastic bottle.

An important feature of the paperboard container 12 of the present invention is the open design of the top flap assembly 30. As previously mentioned, the open design of the top flap asembly 30 allows the receptacle 14 to be easily accessed. The open design also permits the receptacle 14 to be lifted within the paperboard container 12 to improve the angle of pour between the pouring spout 54 and a receiving container.

Referring still to the preferred embodiment illustrated in FIGS. 1–3, the first and second side flaps 32,34 extend from the first and second side walls 20,22 by a distance $D_1$ and $D_2$ respectively. To provide an open top flap assembly 30, $D_1$ and $D_2$ are designed such that when the side flaps 32,34 are folded substantially perpendicular to the side walls 20,22, the side flaps 32,34 are interposed between an end-portion 24,26 of the front wall 16 and a corresponding end-portion 24,26 of the rear wall 18. The side flaps 32,34 are not interposed between the mid-portions 28 of the front 16 and rear 18 walls. The two front flaps 36,38 extend from the front wall 16 by a distance $D_f$ and the two rear flaps 40,42 extend from the rear wall 18 by a distance $D_r$. In the preferred embodiment, $D_f$ and $D_r$ are designed such that when the front 36,38 and rear 40,42 flaps are folded substantially perpendicular to the front 16 and rear 18 walls, portions of the first and second side flaps 32,34 adjacent the mid-portions 28 of the first and second side walls 20,22 are not covered by the front 36,38 and rear 40,42 flaps. Consequently, the front flaps 36,38, rear flaps 40,42 and side flaps 32,34 extend over the top wall 52 of the receptacle 14, but do not extend over the handle 56 or the pouring spout 54.

As illustrated in FIGS. 1–3, the vertical front, rear, and first and second side walls of the receptacle 14 have a height which is less than the height of the front wall 16, rear wall 18, and first and second side walls 20,22 of the paperboard container 12. Accordingly, the receptacle 14 can be lifted from a first position wherein the receptacle 14 rests on the bottom flap assembly of the paperboard container 12 (See FIG. 1), to a second position wherein the top wall 52 of the receptacle 14 engages the top flap assembly 30 (See FIGS. 2–3).

When in the first position, the pouring spout 54 does not extend past the top flap assembly 30. This allows the composite package 10 of the present invention to be easily stacked on top of one another. When in the second position, however, the pouring spout 54 extends beyond the top flap assembly 30, improving the angle between the pouring spout 54 and a receiving container. In order to further improve the pouring angle, the front wall 16 of the paperboard container 12 may have a cut-out portion 58 between the two front flaps 36,38. The cut-out portion 58 allows the receptacle 14 to be positioned directly adjacent the receiving container when pouring product from the composite package 10. Preferably, the cut-out portion 58 is U-shaped.

Figure 6:
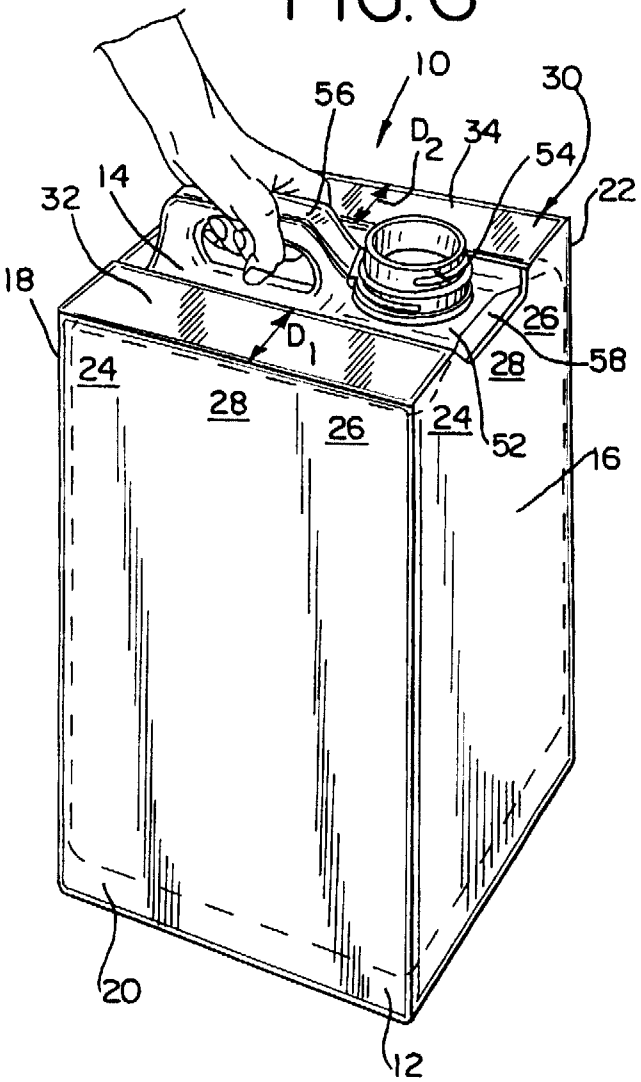
FIG. 6 is a perspective view of the composite package assembly illustrated in FIG. 1 with the top flap assembly in a second folded position and the receptacle in a second raised position within the paperboard container.

With reference specifically to FIG. 2, the top flap assembly 30 of the present invention can be folded and glued in two different manners. In the preferred manner (illustrated in FIG. 2) the front flaps 36,38 and the rear flaps 40,42 are folded over, and glued to, the first and second side flaps 32,34. In a second manner (illustrated in FIG. 6) the first and second side flaps 32,34 are folded over, and glued to, the front 36,38 and rear 40,42 flaps. In the preferred embodiment illustrated in FIG. 2, the longer side flaps 32,34 provide a greater area of support for the front 36,38 and rear 40,42 flaps, resulting in a stronger bond being formed between the side flaps and the front and rear flaps. Thus, the top flap assembly 30 has better structural integrity when assembled in the first manner than when assembled in the second manner.

Figure 4:
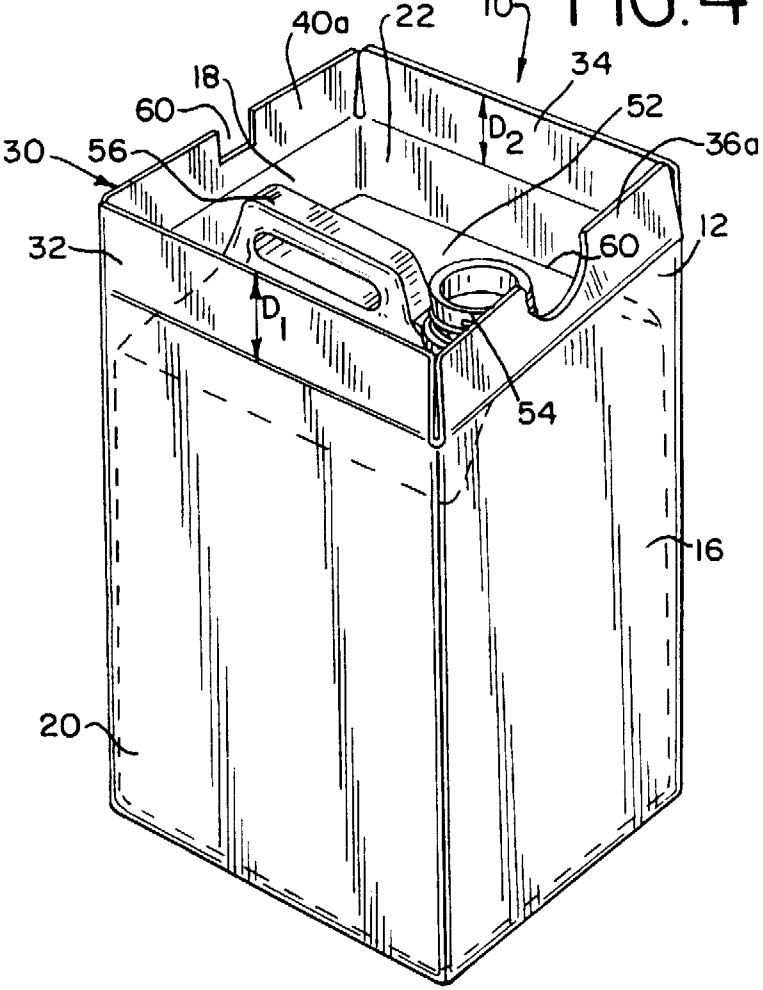
FIG. 4 is a perspective view of a composite package according to a second embodiment of the present invention, illustrating the top flap assembly in an open, unfolded position and the receptacle in a first lowered position within the paperboard container.
Figure 5:
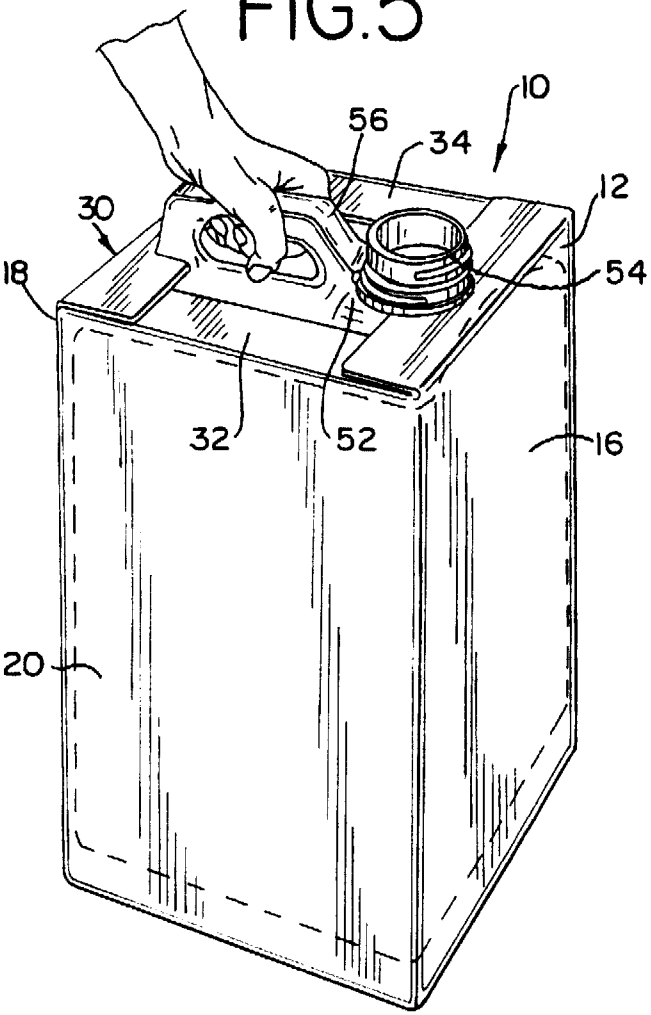
FIG. 5 is a perspective view of the composite package illustrated in FIG. 4 with the top flap assembly in a folded position and the receptacle in a second raised position within the paperboard container.

In a second embodiment illustrated in FIGS. 4–5, the composite package 10 is similar to the one described above and illustrated in FIGS. 1–3 except that the paperboard container 12 includes a top flap assembly 30 having a single front flap 36*a* and a single rear flap 40*a*. The front flap 36*a* is connected to, and folded substantially perpendicular to, the front wall 16 of the paperboard container 12. The rear flap 40*a* is connected to, and folded substantially perpendicular to, the rear wall 18 of the paperboard container 12. The first and second side flaps 32,34 extend from the first and second side walls 20,22 by a distance $D_1$ and $D_2$ respectively. Like the first embodiment, $D_1$ and $D_2$ of the embodiment illustrated in FIGS. 4–5 are designed so that when the side flaps 32,34 are folded substantially perpendicular to the first and second side walls 20,22, the side flaps 32,34 overlie the top wall 52 of the receptacle 14 but do not overlie the handle 56 or the pouring spout 54 of the receptacle 14.

The front flap 36*a* and the rear flap 40*a* are connected along the entire length of the front wall 16 and rear wall 18 respectively. Consequently, the front and rear flaps 36*a*,40*a* each have a cut-out portion 60 corresponding to the size and shape of the handle 56 and pouring spout 54 respectively. Thus, when the front 36*a* and rear 40*a* flaps are folded substantially perpendicular to the front 16 and rear 18 walls, the front 36*a* and rear 40*a* flaps extend over the top wall 52 of the receptacle 14 but do not extend over the pouring spout 54 and handle 56 respectively.

The cut-out portions 60 of the front 36*a* and rear 40*a* flaps allow the pouring spout 54 and the handle 56 respectively, to pass therethrough. Consequently, the receptacle 14 can be lifted within the paperboard container 12 from a first position to a second position. When in the first position, the pouring spout 54 does not extend past the top flap assembly 30. In the second position, however, the pouring spout 54 extends beyond the top flap assembly 30, thus, improving the angle between the pouring spout 54 and a receiving container.

While the composite package of the present invention has been described herein with reference to preferred materials of construction (e.g., paperboard container and plastic receptacle), it should be understood by those skilled in the art that the composite package could constructed from materials different than those used to describe the preferred embodiments. For example, the paperboard container could be constructed from a thermoplastic polymer such as polyethylene or polypropylene. Likewise, the plastic receptacle could be constructed from a metal, metal alloys, or glass.

While the specific embodiments have been illustrated and described, numerous modifications come to mind without markedly departing from the spirit of the invention. The scope of protection is only intended to be limited by the scope of the accompanying claims.

We claim:

1. A paperboard container comprising:

a front wall, rear wall, and first and second side walls, each wall having two end-portions separated by a mid-portion; and a top flap assembly including first and second side flaps connected to and folded substantially perpendicular to the first and second side walls, two front flaps, each front flap connected to an end-portion of the front wall, and two rear flaps, each rear flap connected to an end-portion of the rear wall, the front and rear flaps folded substantially perpendicular to the front and rear walls, wherein the front wall has a cut-out portion between the two front flaps.

2. The paperboard container of claim 1 further comprising a thin-walled receptacle within the paperboard container.

3. The paperboard container of claim 1, wherein the cut-out portion is U-shaped.

4. The paperboard container of claim 1, wherein the front and rear flaps are folded over the first and second side flaps.

5. The paperboard container of claim 1, wherein the first and second side flaps are folded over the front and rear flaps.

6. The paperboard container of claim 1, wherein the first and second side flaps extend from the first and second side walls by a distance $D_1$ and $D_2$ respectively, $D_1$ and $D_2$ being such that when the side flaps are folded substantially perpendicular to the side walls, the side flaps are interposed between an end-portion of the front wall and an end-portion of the rear wall but not interposed between the mid-portions of the front and rear walls.

7. The paperboard container of claim 1, wherein the front flaps extend from the front wall by a distance $D_f$, and the rear flaps extend from the rear wall by a distance $D_r$, $D_f$ and $D_r$ being such that when the front and rear flaps are folded substantially perpendicular to the front and rear walls respectively, the first and second side flaps adjacent the mid-portions of the side walls are left uncovered by the front and rear flaps.

8. The paperboard container of claim 2, wherein the thin-walled receptacle is a rectangular plastic bottle having vertical front, rear, first and second side walls, and a top wall extending across the the vertical walls, a pouring spout formed on the top wall adjacent the front wall, and a handle formed on the top wall and extending between the pouring spout and the rear wall.

9. The paperboard container of claim 8, wherein the front, rear and side flaps of the top flap assembly extend over the top wall of the receptacle, but do not extend over the handle and the pouring spout.

10. A composite package comprising:

a container and a preformed receptacle positioned within the container;

the receptacle having vertical front, rear, first and second side walls, and a top wall extending across the vertical walls, a pouring spout formed on the top wall adjacent the front wall, and a handle formed on the top wall and extending between the pouring spout and the rear wall;

the container having front, rear and first and second side walls adjacent the front, rear and first and second side walls of the receptacle respectively, each wall of the container having two end-portions separated by a mid-portion; and the container having a top flap assembly including first and second side flaps connected to and folded substantially perpendicular to the first and second side walls, two front flaps, each front flap connected to an end-portion of the front wall, and two rear flaps, each rear flap connected to an end-portion of the rear wall, the front and rear flaps folded substantially perpendicular to the front and rear walls.

11. The composite package of claim 10, wherein the container is formed from a paperboard material.

12. The composite package of claim 11, wherein the front and rear flaps are folded over the first and second side flaps.

13. The composite package of claim 11, wherein the first and second side flaps are folded over the front and rear flaps.

14. The composite package of claim 11, wherein the front and rear flaps extend over the top wall of the receptacle but do not extend over the handle and the pouring spout of the receptacle.

15. The composite package of claim 11, wherein the first and second side flaps extend over the top wall of the receptacle but do not extend over the handle and the pouring spout of the receptacle.

16. The composite package of claim 11, wherein the receptacle can be lifted from a first position to a second position.

17. The composite package of claim 16, wherein the pouring spout does not extend beyond the top flap assembly when the receptacle is in the first position.

18. The composite package of claim 16, wherein the pouring spout extends beyond the top flap assembly when the receptacle is in the second position.

19. A composite package comprising:

a paperboard container and a preformed receptacle positioned within the container;

the receptacle having vertical front, rear, first and second side wall, and a top wall extending across the vertical walls, a pouring spout formed on the top wall adjacent the front wall, and a handle formed on the top wall and extending between the pouring spout and the rear wall;

the paperboard container including a front wall, rear wall and fist and second side walls, each wall having two end-portions separated by a mid-portion;

a top flap assembly including first and second side flaps connected to and folded substantially perpendicular to the first and second sidewalls respectively, a front flap connected to the front wall, and a rear flap connected to the rear wall, the front and rear flaps folded substantially perpendicular to the front and rear walls respectively;

the front and rear flaps extending over the top wall of the receptacle, but not extending over the handle and the pouring spout of the receptacles the front and rear flaps having cut out portions which allow the pouring spout and the handle to pass through, respectively when the receptacle is lifted from a first position in the container to a second position in the container.

20. A composite package comprising:

a container and a preformed receptacle positioned within the container;

the receptacle having vertical front, rear, first and second side walls, and a top wall extending across the vertical walls, a pouring spout formed on the top wall adjacent the front wall and a handle formed on the top wall and extending between the pouring spout and the rear wall;

the container including a front wall, rear wall, and first and second side walls, each wall having two end-portions separated by a mid-portion;

a top flap assembly including first and second side flaps connected to and folded substantially perpendicular to the first and second side walls, a front flap connected to the front wall, and a rear flap connected to the rear wall, the front and rear flaps folded substantially perpendicular to the front and rear walls;

the first and second side flaps extending from the first and second sidewalls by a distance $D_1$ and $D_2$ respectively, $D_1$ and $D_2$ being such that when the side flaps are folded substantially perpendicular to the side walls the side flaps overlie the top wall of the receptacle, but do not overlie the handle and the pouring spout of the receptacle; and the pouring spout extending beyond the top flag assembly when receptacle is lifted from a first position in the container to a second position in the container.

21. The composite package of claim 20, wherein the container is formed from a paperboard material.

22. The composite package of claim 21, wherein the front and rear flaps each include a cut-out portion which allows the pouring spout and the handle respectively to pass therethrough.

* * * * *

UNITED STATES PATENT AND TRADEMARK OFFICE

CERTIFICATE OF CORRECTION

PATENT NO. : 5,765,711
DATED : June 16, 1998
INVENTOR(S) : Ralph W. Johnson and Gerald D. Williams It is certified that error appears in the above-identified patent and that said Letters Patent is hereby corrected as shown below:

Column 8 Line 34 CHANGE "top flag" TO "top flap"

Signed and Sealed this

Third Day of August, 1999

*Attest:*

Q. TODD DICKINSON

*Attesting Officer*

*Acting Commissioner of Patents and Trademarks*